United States Patent [19]

Bade

[11] Patent Number: 4,747,442

[45] Date of Patent: May 31, 1988

[54] CURTAIN

[75] Inventor: Heinz Bade, Greven, Fed. Rep. of Germany

[73] Assignee: Cordes Gesellschaft mit beschränkter Haftung & Co., Greven, Fed. Rep. of Germany

[21] Appl. No.: 901,758

[22] Filed: Aug. 28, 1986

[30] Foreign Application Priority Data

May 29, 1986 [GB] United Kingdom ..... 8613016

[51] Int. Cl.[4] ..... A47H 13/14

[52] U.S. Cl. ..... 160/348; 160/330

[58] Field of Search ..... 160/348, 330, 344, 345, 160/123, 124, 126

[56] References Cited

U.S. PATENT DOCUMENTS

| | | | |
|---|---|---|---|
| 2,126,834 | 8/1938 | Steinberger | 160/348 |
| 2,159,734 | 5/1939 | French | 160/344 |
| 2,410,224 | 10/1946 | Lepow | 160/348 |
| 2,804,138 | 8/1957 | Nichols | 160/348 |
| 2,868,286 | 1/1959 | Odermann | 160/348 |
| 2,985,235 | 5/1961 | Landell | 160/348 |
| 3,741,259 | 6/1973 | Wood et al. | 160/348 X |

FOREIGN PATENT DOCUMENTS

| | | | |
|---|---|---|---|
| 575084 | 4/1959 | Canada | 160/348 |
| 1260719 | 2/1968 | Fed. Rep. of Germany . | |
| 2205478 | 8/1973 | Fed. Rep. of Germany | 160/348 |

*Primary Examiner*—Ramon S. Britts
*Assistant Examiner*—David M. Purol
*Attorney, Agent, or Firm*—Peter K. Kontler

[57] ABSTRACT

A curtain wherein an elongated horizontal tape is attached in part to the rear side of the panel behind the upper edge of the panel. The upper marginal portion of the tape has alternating attached and non-attached sections, and the same applies for the lower marginal portion of the tape. The non-attached sections of the upper marginal portion are disposed above the attached sections of the lower marginal portion and the non-attached sections of the lower marginal portion are disposed below the non-attached sections of the upper marginal portion. When the width of the panel is reduced, the panel forms forwardly extending folds in the region of non-attached sections of the two marginal portions of the tape and folds which extend rearwardly in the regions of attached sections of the two marginal portions. The two marginal portions flank a channel which is defined by the tape and by the rear side of the panel and serves to receive a curtain rod. The flexibility of the panel exceeds the flexibility of the tape.

12 Claims, 1 Drawing Sheet

CURTAIN

BACKGROUND OF THE INVENTION

The present invention relates to foldable articles in general, especially to articles which can be utilized as curtains or the like.

It is well known to mount a curtain on a rod in such a way that the upper portion of the curtain forms or can form a plurality of folds. Such folding is desirable and advantageous in order to enhance the appearance of the curtain as well as to enable the curtain to cover a portion of or the entire window, door or other structure behind or in front of it.

In accordance with a presently known proposal which is disclosed in German Auslegeschrift No. 1,260,719, a relatively stiff tape is inserted into the upper marginal portion of the curtain and the tape is weakened at selected intervals so as to enable or to compel the curtain to form folds of predetermined size. A drawback of such proposal is that the curtain must be suspended on a rod by means of hooks or rollers.

In accordance with a different prior proposal, a continuous stiff tape is replaced by a series of discrete rigid plates which are normally made of a plastic material. The curtain can be folded in regions between neighboring plates. This proposal exhibits the same drawback as that in the aforediscussed German publication, namely the upper marginal portion of the curtain must be suspended on the rod by means of hooks and/or rollers. Alternatively, specially designed tracks must be provided to receive the topmost portion of the curtain.

In accordance with another earlier proposal, the upper marginal portion of a curtain can be folded by means of so-called draw tapes. This proposal exhibits the drawback that it is necessary to form accurately shaped additional loops.

OBJECTS AND SUMMARY OF THE INVENTION

An object of the invention is to provide an article which can constitute, or which can be used as, a curtain and wherein a flexible panel can be caused to form folds in a novel and improved way.

Another object of the invention is to provide an article which can be readily mounted on a simple or complex rod, such as a curtain rod, without resorting to hooks, wheels and other auxiliary components.

An additional object of the invention is to provide an article which can be used as a curtain and can be attached to existing curtain rods or like supports.

Still another object of the invention is to provide an article which can be designed to induce a panel of flexible material to form folds of practically any desired size and shape.

A further object of the invention is to provide novel and improved means for facilitating folding of the upper marginal portion of a curtain in a simple an inexpensive way.

Another object of the invention is to provide a novel and improved device for folding a curtain in response to shifting of the curtain along the curtain rod.

A further object of the invention is to provide a folding device which can be attached to existing curtains as a substitute for heretofore known folding devices.

The invention resides in the provision of a foldable or flexible article, particularly a curtain, which comprises a flexible panel of textile or other material, and an elongated flexible strip-shaped member which is adjacent one side of the panel. The strip-shaped member has first and second marginal portions which include alternating first and second sections attached to and movable relative to the panel, respectively. The first sections of the first marginal portion are aligned with the second sections of the second marginal portion and vice versa. The strip-shaped member can be applied to the panel along one edge of the panel. If the article is to be used as a curtain, the panel and the strip-shaped member define an elongated channel which is flanked by the marginal portions and can receive a curtain rod or a like elongated support. The strip-shaped member and/or the panel can be made of a suitable textile material.

The flexibility of the panel can exceed the flexibility of the strip-shaped member.

At least some second sections of the strip-shaped member can constitute pockets (for example, substantially V-shaped or substantially U-shaped pockets) having open sides, and the open sides of pockets in one of the marginal portions face away from the other marginal portion of the strip-shaped member and vice versa.

At least some second sections of one or both marginal portions of the strip-shaped member can be provided with preferably centrally located weakened portions which extend substantially transversely of the strip-shaped member. Furthermore, those sections of the panel which are adjacent the second sections of the first and second marginal portions of the strip-shaped member can be provided with substantially centrally located weakened portions which extend transversely of the strip-shaped member. The weakening of second sections of the marginal portions and/or of the aforementioned sections of the panel promotes and facilitates predictable folding of the panel in response to its narrowing, i.e., in response to shifting of one end of the strip-shaped member toward the other end while a curtain rod extends through the aforementioned channel between the marginal portions of the strip-shaped member.

The length of first sections forming part of the first marginal portion of the strip-shaped member (as measured in the longitudinal direction of the strip-shaped member) can deviate from the length of first sections of the second marginal portion.

The first sections of the marginal portions of the strip-shaped member can be stitched and/or glued and/or otherwise bonded or secured to the panel.

The depth of the aforementioned pockets which constitute or form part of second sections of the two marginal portions can be selected in such a way that the pockets of one marginal portion partially overlap the pockets of the other marginal portion, i.e., the depth of at least one set of pockets preferably equals or exceeds half the width of the strip-shaped member.

The novel features which are considered as characteristic of the invention are set forth in particular in the appended claims. The improved curtain itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
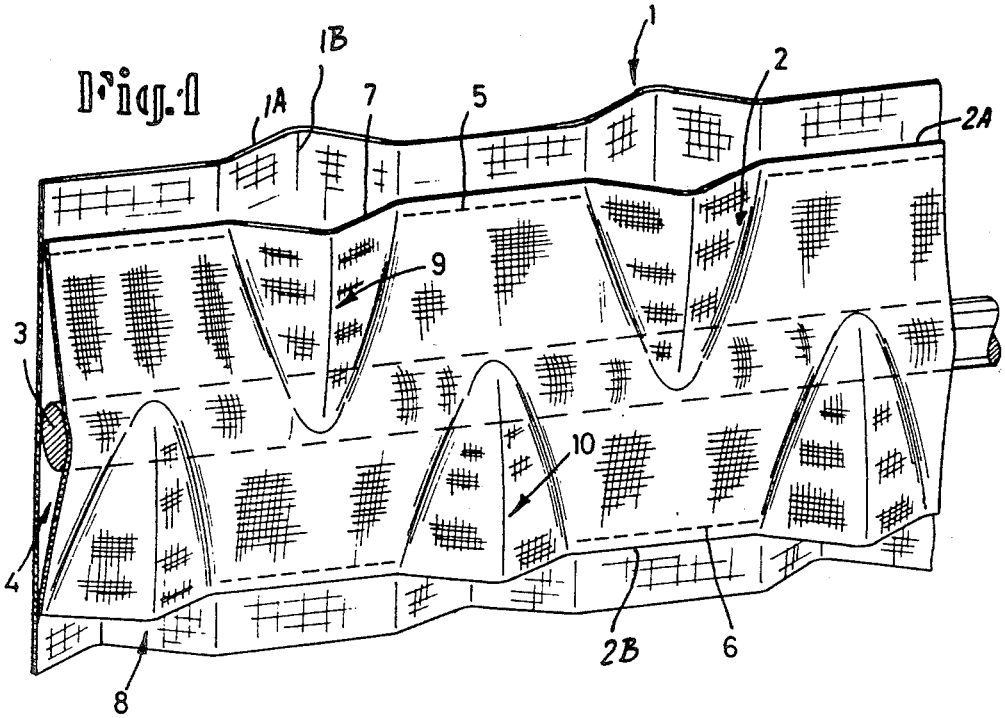
FIG. 1 is a fragmentary elevational view of an article which embodies the present invention, showing the rear side of the panel and a portion of the strip-shaped member, the panel and the strip-shaped member being deformed in such a way that the panel develops relatively small spaced-apart loops.

Referring first to FIG. 1, there is shown a portion of an article which can constitute a curtain and includes a panel or curtain proper (denoted by the character 1) and an elongated strip-shaped member 2 (hereinafter called tape for short) which is applied to the rear side of the panel 1 adjacent the upper edge of the latter. The panel 1 can be made of a suitable textile material, and the same applies for the tape 2. However, it is equally within the purview of the invention to make the panel and/or the tape of any other suitable flexible material, for example, from a synthetic plastic foil material or the like. In accordance with a presently preferred embodiment of the invention, the flexibility of the panel 1 exceeds the flexibility of the tape 2.

The tape 2 has two marginal portions 2A and 2B which flank an elongated channel or passage 4 for a simple or complex curtain rod 3. The drawing shows a rod having a circular cross-sectional outline; however, the improved article can be mounted with equal advantage on a rod which has a polygonal or any other customary or desired cross sectional outline without departing from the spirit of the invention.

The upper marginal portion 2A of the tape 2 has alternating first sections 5 which are attached to the rear side of the panel 1 and second sections 7 which are not attached and resemble or constitute substantially U-or V- shaped pockets having open sides facing upwardly toward the edge of the panel 1. The lower marginal portion 2B of the tape 2 has first sections 6 which are attached to the panel 1 and second sections or pockets 8 which are not attached and alternate with the sections 6. The arrangement is such that each attached section 5 is disposed opposite a non-attached section 8 and each attached section 6 is disposed opposite a non-attached section or pocket 7. As shown in the drawing, the sections 5 and 6 are stitched to the panel 1. However, it is equally possible to bond the sections 5 and 6 to the adjacent portions of the panel 1 or to use an adhesive as well as one or more rows of stitches.

The width of the sections 7 (as considered in the longitudinal direction of the tape 2) may but need not equal the width of the sections 8. In other words, the length of the attached sections 5 (again as measured in the longitudinal direction of the tape 2) may but need not equal the length of the attached sections 6.

In order to promote predictable folding of the panel 1 in the region of its upper edge, the sections 7 of the upper marginal portion 2A are preferably provided with centrally located weakened portions 9 which extend transversely of the tape 2, and similar weakened portions 10 are provided or can be provided in the sections 8 of the marginal portion 2B. Predictable folding of the panel 1 can be enhanced still further if the panel sections 1A which are disposed in front of the sections 7 and/or 8 are also provided with centrally located weakened portions 1B extending transversely of the longitudinal direction of the tape 2.

Figure 2:
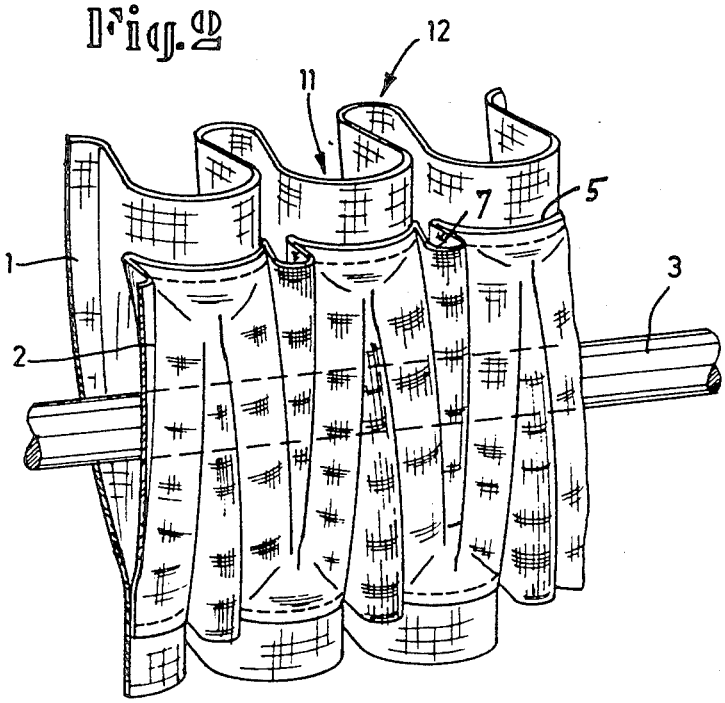
FIG. 2 illustrates the structure of FIG. 1 but with the panel and strip-shaped member deformed so that the upper marginal portion of the panel forms a plurality of pronounced loops.

As shown in FIG. 2, when the curtain including the panel 1 and tape 2 is pushed together by shifting one end of the tape toward the other end, the upper portion of the panel 1 develops pronounced fold dips 11 which alternate with fold ridges 12. The dips 11 are formed in the regions of the sections 5, and the ridges 12 are formed in the regions of the sections 7. The sections 7 simultaneously form folds which extend rearwardly of and away from the respective fold ridges 12. Similar formations develop at a level below the curtain rod 3, i.e., each section 8 is located behind a fold ridge and each section 6 is located behind a fold dip of the panel 1. The folds or loops can be enlarged or reduced (made deeper or shallower) by the simple expedient of expanding or narrowing the panel 1 in the longitudinal direction of the rod 3.

The configuration of the loops or folds which are formed by the panel 1 can be influenced in a number of ways. This enables the manufacturer of curtains or similar products to satisfy many specific requests of the customers by properly selecting the dimensions (length) of the first sections 5 and 6 of the marginal portions 2A and 2B of the tape 2. The exact color of the tape 2 is of no consequence, especially if the panel 1 does not transmit light, because the tape is applied to the rear side of the panel. The number of folds can also be selected at will by properly selecting the width of the panel 1 (in comparison with the length of the rod 3) and the length of the tape 2.

The improved article can be mounted on existing curtain rods. The folds or loops are formed automatically in response to shifting of one end of the tape 2 toward the other end or by pushing both ends of the tape and the corresponding portions of the panel 1 toward each other. The panel 1 automatically billows forwardly in regions in front of the non-attached sections 7 and 8 and billows rearwardly in the regions of attached sections 5 and 6. This results in the formation of a so-called smock fold which is of eye-pleasing appearance. In order to form a series of identical eye-pleasing folds, it is merely necessary to ensure that the length of all sections 5 will be the same as well as that the length of all sections 6 will be the same. However the length of sections 6 need not match or approximate the length of the sections 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A foldable article, particularly a curtain, comprising a flexible panel having a first side and a second side; and an elongated flexible strip-shaped member adjacent one side of said panel, said member having first and second marginal portions, said first marginal portion including first sections secured to said panel and second sections unattached to said panel wherein each of said first sections are contingent with each of said second sections to thereby define pockets, said second marginal portion including first sections secured to said panel and second sections unattached to said panel wherein each of said first sections are contingent with each of said second sections to thereby define pockets, and wherein the first sections of said first marginal portion are aligned with the second sections of said second marginal portion as considered in said strip-shaped member.

2. The article of claim 1, wherein said panel has an edge and said member is adjacent and extends along said edge.

3. The article of claim 1, wherein said panel and said member define an elongated channel which is flanked by said marginal portions and can receive a curtain rod or the like.

4. The article of claim 1, wherein said member contains a textile material.

5. The article of claim 1, wherein the flexibility of said panel exceeds the flexibility of said member.

6. The article of claim 1, wherein at least some of said second sections are pockets having open sides, the open sides of pockets in one of said marginal portions facing away from the other marginal portion and vice versa.

7. The article of claim 1, wherein at least some of said second sections have weakened portions extending transversely of said member.

8. The article of claim 1, wherein said panel has sections adjacent the second sections of said marginal portions and at least some sections of said panel have substantially centrally located weakened portions extending transversely of said member.

9. The article of claim 1, wherein the length of first sections of said first marginal portion in the longitudinal direction of said member deviates from the length of first sections of said second marginal portion.

10. The article of claim 1, wherein said first sections are stitched to said panel.

11. The article of claim 1, wherein said first sections are bonded to said panel.

12. The article of claim 1, wherein said second sections are pockets and the depth of said pockets, as measured transversely of said member, at least equals half the width of said member.

* * * * *